United States Patent [19]

Lacroix

[11] Patent Number: 4,511,326

[45] Date of Patent: Apr. 16, 1985

[54] GAS-SUPPLY SYSTEM FOR CATALYTIC GAS BURNERS

[75] Inventor: Alain Lacroix, Rhone, France

[73] Assignee: Societe Lyonnaise des Applications Catalytiques, Rillieux-La-Pape, France

[21] Appl. No.: 372,053

[22] Filed: Apr. 26, 1982

[30] Foreign Application Priority Data

Apr. 24, 1981 [FR] France ..... 81 08815

[51] Int. Cl.[3] ..... F23Q 9/08

[52] U.S. Cl. ..... 431/53; 236/68 D

[58] Field of Search ..... 236/68 D; 431/43, 47, 431/53, 54

[56] References Cited

U.S. PATENT DOCUMENTS 3,091,285 5/1963 Hassa ..... 431/54

*Primary Examiner*—Carroll B. Dority, Jr.

*Attorney, Agent, or Firm*—Karl F. Ross; Herbert Dubno

[57] ABSTRACT

A catalytic gas burner, as used e.g. in a mobile space heater, comprises a valve housing divided by at least two poppet valves into three or more cascaded chambers. One chamber communicates with a gas inlet and is normally closed by a first poppet valve which can be opened by a push rod and held open by an electromagnet, the latter being energized under the control of a thermocouple as long as an adjoining ancillary nozzle emits a monitoring flame. This nozzle communicates with another chamber to which gas is admitted in the open state of the first poppet valve and which also feeds the main nozzle head of the burner through a supply conduit including a manually and/or thermally controlled flow regulator. A second poppet valve, fixed to the push rod, is open as long as that rod is depressed against a spring force to give access to a further chamber from which supplemental gas is conveyed through another conduit to the nozzle head during a start-up phase while an igniter is being actuated. As long as the first poppet valve is open, gas passes through a throttled branch of the supply conduit to the nozzle head by way of the flow regulator which also has a passage controlled by a piston for letting additional gas from another branch of that conduit enter the nozzle head at a variable rate until the desired temperature has been reached.

11 Claims, 6 Drawing Figures

GAS-SUPPLY SYSTEM FOR CATALYTIC GAS BURNERS

FIELD OF THE INVENTION

My present invention relates to a system for supplying a heating gas to a nozzle assembly of a catalytic burner forming part, for example, of a mobile space heater.

BACKGROUND OF THE INVENTION

During a start-up phase, in which the burner is ignited and which may last for about a minute, such a catalytic burner must be supplied with gas at a higher rate than is necessary for sustaining a flame during a subsequent operating phase. It is also desirable to provide means for varying the flow rate of the gas during that operating phase, either manually or automatically in response to changes in ambient temperature, as well as means for continuously monitoring the atmosphere of the burner in order to detect a possible interruption of the gas flow.

Thus, a mechanism designed to control the supply of heating gas to the burner should be able to perform the three functions of (a) temporarily increasing the flow rate on start-up, (b) varying the reduced flow rate in the subsequent operating phase and (c) shutting off the flow in the event of an extinction of the flame. Ordinary valves of the rotary-cock type are not suitable for this purpose since they generally can establish only a limited number of working positions corresponding to maximum flow rate, reduced flow rate and cutoff. Slide valves, such as those of the needle type, are more versatile but are also difficult to adapt to the aforestated requirements.

If, as is usually the case with mobile units, the burner is not equipped with a permanently lit pilot flame, an igniter must be activated during the start-up phase. The control mechanism for such a unit, therefore, will also have to be designed to operate the igniter.

OBJECT OF THE INVENTION

The object of my present invention, accordingly, is to provide a simple control mechanism for the purpose described.

SUMMARY OF THE INVENTION

A gas-supply system according to my invention comprises valve means having a housing which is subdivided into several chambers including a first chamber with an inlet connected to a source of heating gas under pressure, a second chamber communicating with that first chamber via a first passage which can be blocked by a first valve member, and a third chamber communicating with the first chamber (preferably by way of the second chamber) via a second passage blockable by a second valve member; the two valve members may be of the simple poppet type and are respectively provided with first and second springs tending to keep the corresponding passages closed. A nozzle assembly of a burner served by this system is connected to the second chamber by first conduit means and to the third chamber by second conduit means, the first conduit means also including a manually or automatically settable flow regulator. A manually operable control element, such as a push rod, is positively linked with the second valve member for moving same against its spring force to open the second passage upon displacement of that control element from a normal into an off-normal position, such displacement also moving the first valve member against the spring force thereof into an unblocking position; this causes the flow of gas through all three chambers as well as through the first and second conduit means to the nozzle assembly in a start-up phase during which the control element is displaced. Upon the release of that element at the beginning of an operating phase, the first valve member is held in its unblocking position by electromagnetic detent means responsive to a monitoring device in the burner; thus, gas continues to flow to the nozzle assembly by way of the first conduit means only, provided that the burner is lit. If the flame goes out, the monitoring device de-energizes the electromagnetic detent means so that the first valve member is returned by its spring to its blocking position and completely shuts off the gas flow.

The monitoring device may comprise a thermoelectric sensor juxtaposed with one of the burner nozzles, preferably a nozzle connected to the second valve chamber via a separate pipe forming part of the aforementioned first conduit means.

The flow regulator may comprise a cylinder with a first entrance port connected to a restricted branch and a second entrance port connected to a relatively unrestricted branch of the first conduit means, this cylinder having a seat between the two entrance ports which coacts with a piston serving for the selective throttling of the gas flow through the unrestricted branch to an exit port beyond the seat without affecting the flow through the restricted branch to that exit port. The piston may be manually displaceable in the cylinder but could also be operatively coupled with thermometric means for displacement toward its seat in response to rising temperatures in a space heated by the burner.

Advantageously, pursuant to a further feature of my invention, the burner is equipped with a gas-operated igniter connected to the third valve chamber (directly or through a fourth chamber) for fueling during the start-up phase. Such an igniter may be of the piezoelectric type, generating sparks in response to gas pressure, or may comprise a nozzle provided with a resistance wire which is electrically heated to a glow. In either case, of course, the control element will close an energizing circuit for the igniter in its off-normal position.

BRIEF DESCRIPTION OF THE DRAWING

The above and other features of my invention will now be described in detail with reference to the accompanying drawing in which.

SPECIFIC DESCRIPTION

Figure 1:
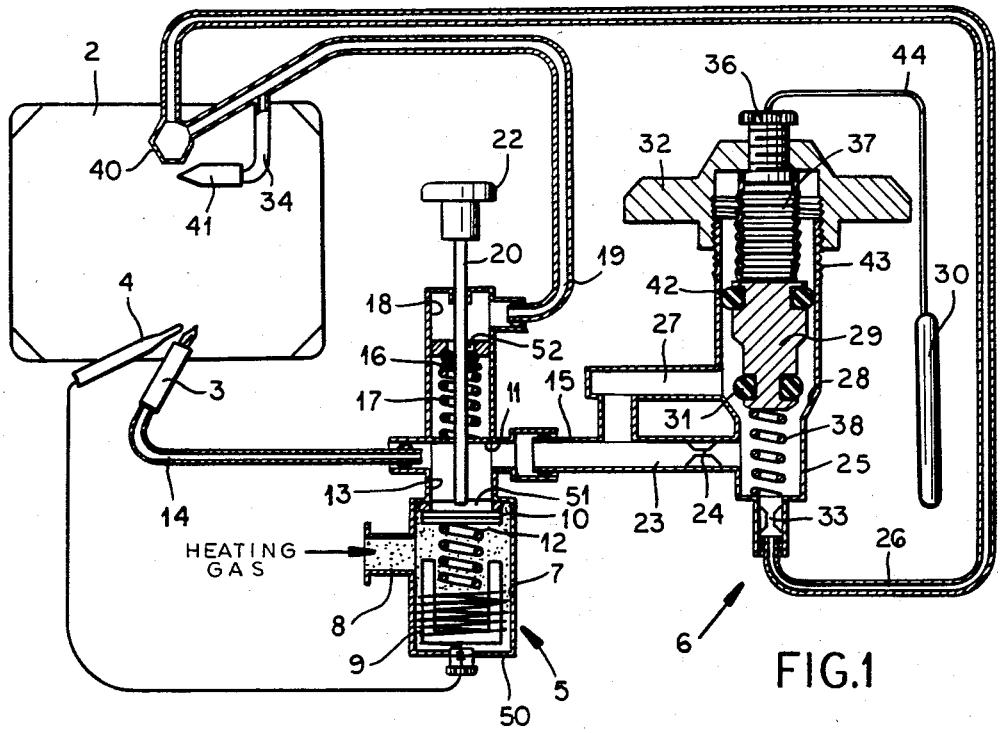
FIG. 1 is a somewhat diagrammatic view of a burner provided with a gas-supply system according to my invention, including a valve mechanism and a flow regulator, shown in an inactive state.

A catalytic burner 2, shown in FIGS. 1–4, has a main nozzle head 40 as well as an ancillary nozzle 3, the latter being closely juxtaposed with a thermoelectric sensor 4 forming therewith a device for monitoring the burner atmosphere to detect possible interruptions of a flow of heating gas to nozzle assembly 3, 40. Such heating gas is delivered under pressure from a nonillustrated source to a valve mechanism 5 via an inlet 8 of a valve housing 50 opening into a first chamber 7 thereof. Chamber 7 is connected with an adjoining second chamber 13 by way of a passage 51 which in the inactive position of FIG. 1 is blocked by a poppet-type valve member 10 under pressure of a biasing spring 12. Another passage 52 connects chamber 13 with a third chamber 18 but is normally blocked by a poppet-type valve member 16 under pressure of a biasing spring 17 resting on an inner shoulder 11 of chamber 13. Chamber 7 contains an electromagnet 9 which partly surrounds the coil spring 12 and confronts the valve member 10 serving as an armature thereof. Thus, member 10 is a ferromagnetic disk whereas member 16 is designed as a spring anchor carrying an annular rubber gasket. An energizing circuit for electromagnet 9, not illustrated in detail, includes a wire 53 linking the coil of that magnet to the thermoelectric sensor 4 which closes the circuit as long as a flame is lit at the end of nozzle 3; such a flame comes into existence shortly after gas issuing from nozzle head 40 is ignited as more fully described hereinafter.

Nozzle 3 is connected to valve chamber 13 via a pipe 14 while a conduit 15 originating at that chamber extends to a flow regulator 6 controlling the supply of heating gas to nozzle head 40 via a conduit 26; another conduit 19 extends from valve chamber 18 to that nozzle head and has a branch 34 terminating at an igniter 41 of the gas-operated type discussed hereinafter. Flow regulator 6 comprises a cylinder 25 forming a frustoconical seat 28 between two entrance ports connected to respective branches 23 and 27 of conduit 15; branch 23 has a throttle 24 restricting the flow of gas therethrough. Conduit 26 is joined to an exit port of cylinder 25 provided with a throttle 33. Pipe 14 could also be branched off conduit 15 instead of extending from a separate outlet of valve chamber 13.

Piston 29 is guided in cylinder 25 by an annular rubber gasket 42 and carries a similar gasket 31 confronting the seat 28 from which it is normally held separated by a biasing spring 38 to provide a clearance for the passage of gas from branch 27 to conduit 26. Cylinder 25 has a threaded extension 43 engaged by a correspondingly threaded knob 32 which is fitted with a threaded nipple 36 opening into a bellows 37, the latter being fixedly connected with piston 29. Nipple 36 communicates via a tube 44 with the interior of a bulb 30 which is filled with a heat-expandable fluid to act as a thermometer sensing the temperature of a space heated by burner 2. When that temperature is low, bellows 37 is relatively contracted to hold the gasket 31 of piston 29 away from seat 28; when the temperature is high, gasket 31 is pressed against that seat to shut off the connection between branch 27 and conduit 26. The piston 29 can be preset by a rotation of knob 32 relative to cylinder extension 43.

A manually operable control element comprises a rod 20 provided with a pushbutton 22; that rod traverses the passage 52 and is fixedly secured to valve member 16 so as to be normally held in the extended position of FIG. 1 by spring 17.

Figure 2:
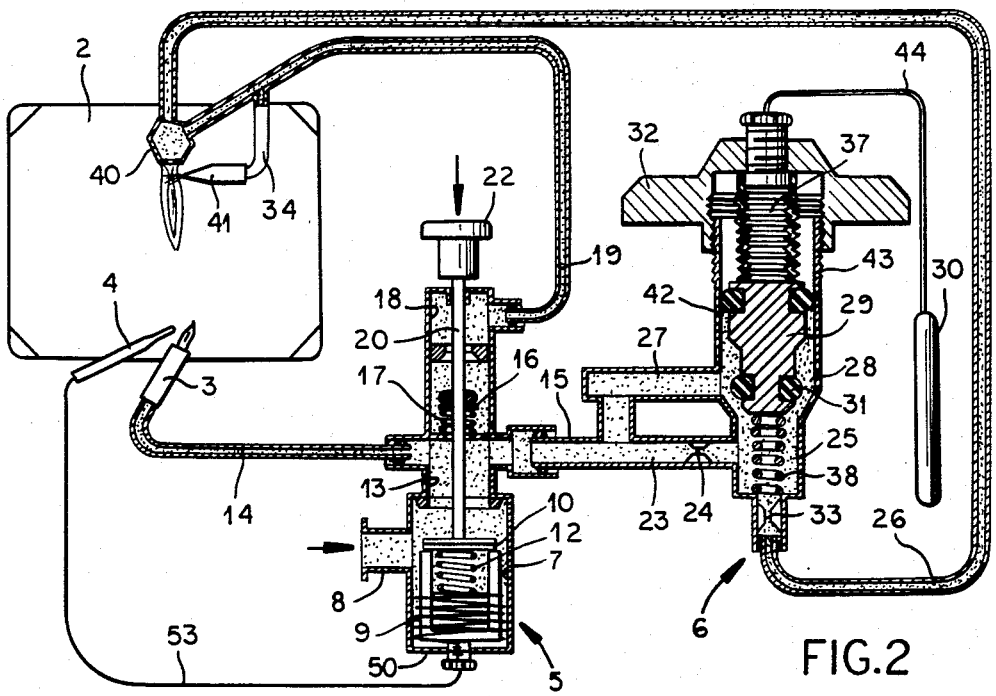
FIGS. 2–4 are views similar to FIG. 1, showing the system in different stages of operation.
Figure 3:
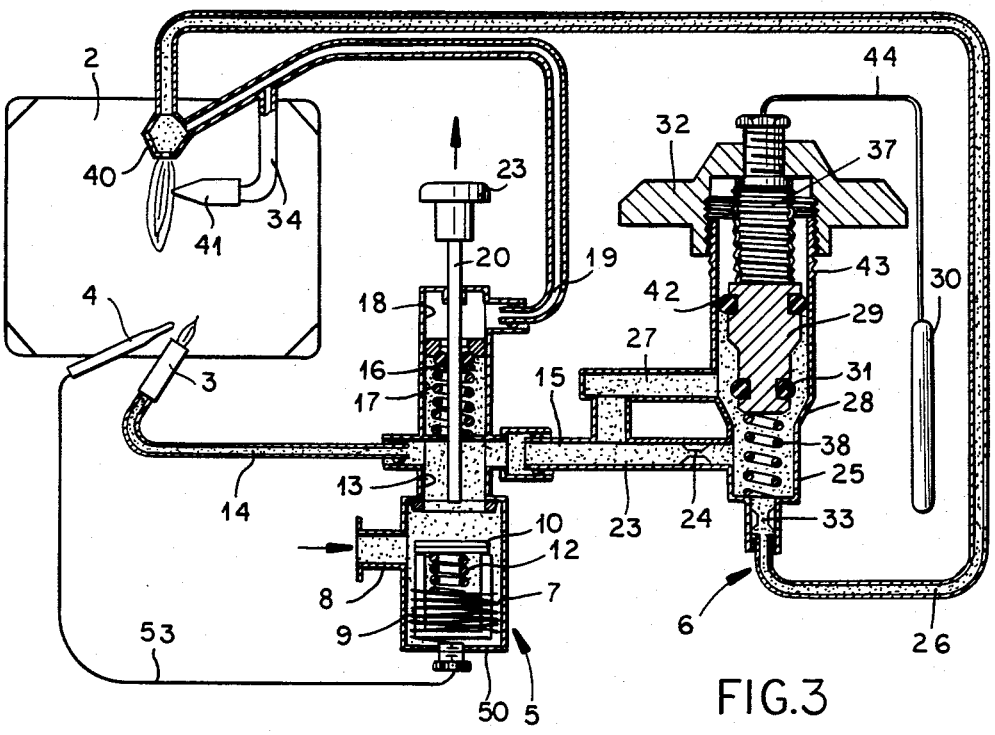

In the inactive state illustrated in FIG. 1, passages 51 and 52 are both blocked by the respective valve members 10 and 16. When the user then depresses the pushbutton 22, rod 20 opens both passages by positively entraining the valve member 16 and thrusting the valve member 10 away from its seat against the force of spring 12 until the latter member comes to rest on the core of electromagnet 9. Gas entering the chamber 7 through inlet 8 now travels through passage 51 into chamber 13 and from there to monitoring nozzle 3 via pipe 14, to regulator 6 via conduit 15 and to chamber 18 via passage 42. Thus, as shown in FIG. 2, gas now fills the entire distribution network including the three cascaded valve chambers so as to reach igniter 41, the main nozzles of heat 40 and the ancillary nozzle 3; with igniter 41 activated by a nonillustrated switch closed by the depressed pushbutton 22, the gas entering that igniter via conduit branch 34 gives rise to a temporary pilot flame which lights the nozzles of burner head 40 as the latter is fueled by way of both conduits 19 and 26. The flames emanating from head 40 also ignite the ancillary nozzle 3, causing sensor 4 to close the energizing circuit to electromagnet 9 whereby valve member 10 is held in its unblocking position when the pushbutton 22 is released after about one minute as shown in FIG. 3. This release shuts off the gas flow through conduit 19 and thus diminishes the supply of nozzle head 40 while deactivating the igniter 41.

Figure 4:
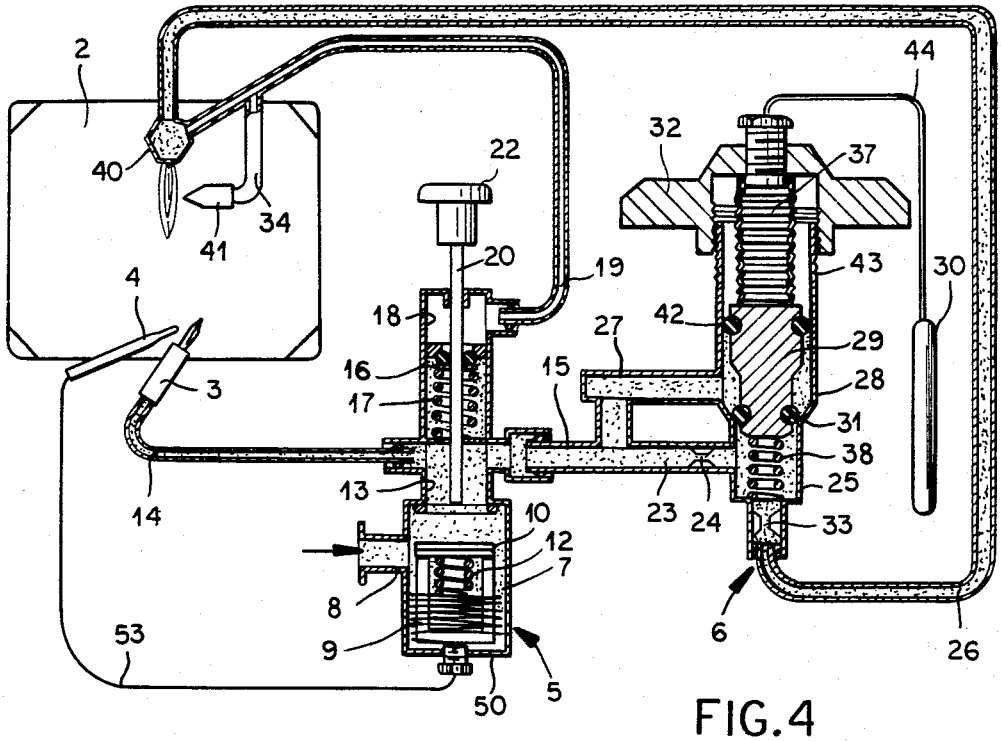

As the space heated by the burner approaches the temperature selected by the setting of knob 32, gasket 31 of piston 29 progressively restricts the gas flow through branch 27 until that flow is completely cut off as shown in FIG. 4. The restricted flow through the throttled branch 23, however, continues to sustain the flames of the nozzle head 40; the independently supplied nozzle 3 also remains lit for continued energization of electromagnet 9. Sensor 4 is largely unaffected by the operation of regulator 6 in view of its proximity to the substantially constant monitoring flame of nozzle 3. If, however, the gas supply is interrupted at any time after the restoration of pushbutton 22 to its normal position, that flame is extinguished and sensor 4 goes cold, thereby de-energizing the electromagnet and releasing the valve member 10 which thereupon recloses the passage 51 under the force of its biasing spring 12. To restart the burner, the user must then again depress the pushbutton.

The gas-operated igniter 41 could be replaced by a manually pre-ignited pilot light directly connected to the source of heating gas via a line which the user must shut off with the aid of a separate valve after the start-up phase to prevent the emission of unburned gas by the igniter in the wake of a temporary failure of the supply. Such an arrangement would obviously be less convenient than the one just described.

Figure 5:
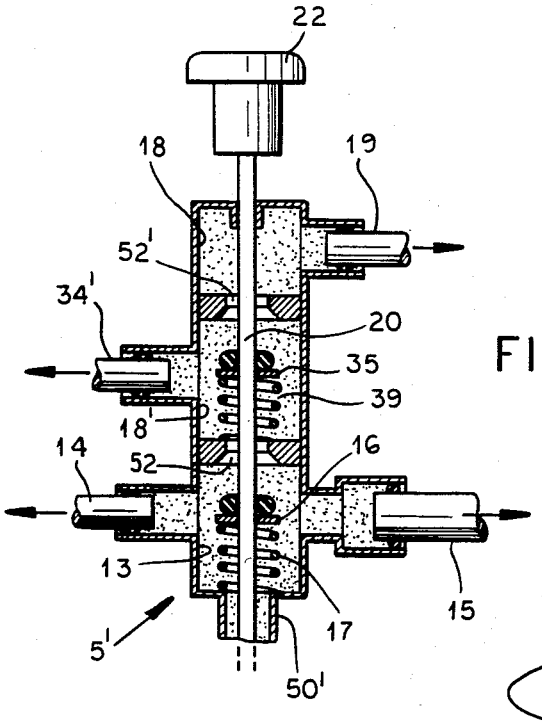
FIG. 5 shows part of a modified valve mechanism adapted to be used in the system of FIGS. 1–4.

In FIG. 5 I have shown a modified valve mechanism 5′ with a housing 50′ containing a fourth valve chamber 18′ which in effect constitutes an extension of the third chamber 18 but is separated therefrom by a passage 52′ closable by a further poppet-type valve member 35 under pressure of a spring 39; this valve member, like member 16, is rigid with pushbutton stem 20 so that passage 52′ is open only when the pushbutton is depressed. A conduit 34′ extending from chamber 18′ supplies the igniter 41 (FIGS. 1–4) during the start-up phase; the operation of the igniter, therefore, corresponds to that described above.

Figure 6:
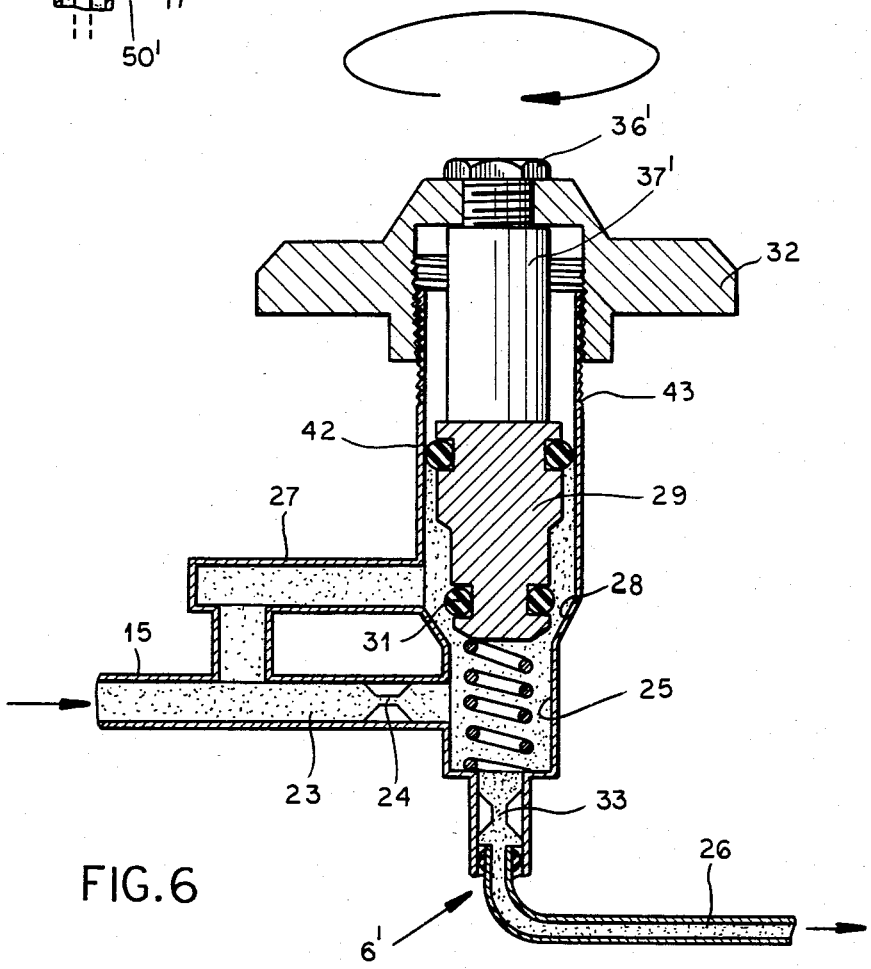
FIG. 6 illustrates a modification of the flow regulator of FIGS. 1–4.

A modified flow regulator 6′, shown in FIG. 6, differs from the regulator 6 of FIGS. 1∝4 in that bellows 37 has been replaced by a rigid body 37′ secured to knob 32 by a threaded bolt 36′. In this instance, therefore, the position of piston 29 is controlled only by hand through rotation of knob 32.

It will be noted that subunits 5 and 6 (or 5' and 6') are detachably connected to conduits 14, 15, 19 and 26 so as to be separable from each other and from the associated burner 2.

I claim:

1. A system for supplying a heating gas to a nozzle assembly of a catalytic burner at a higher rate during a start-up phase and at a lower rate during an operating phase, comprising:

valve means having a housing subdivided into a pluraity of chambers including a first chamber with an inlet connected to a source of heating gas under pressure, a second chamber communicating with said first chamber via a first passage blockable by a first valve member, and a third chamber communicating with said second chamber via a second passage blockable by a second valve member, said first and second valve members being respectively provided with first and second spring means tending to keep said first and second passages closed;

monitoring means in said burner for detecting the absence of a flame in said operating phase;

first conduit means extending to said nozzle assembly from said second chamber;

second conduit means extending to said nozzle assembly from said third chamber;

flow-regulating means in said first conduit means;

a manually operable control element positively linked with said second valve member for moving same against the force of said second spring means to open said second passage upon displacement of said control element from a normal position into an off-normal position, said first valve member being movable against the force of said first spring means into an unblocking position by said control element upon displacement thereof into said off-normal position with resulting gas flow to said nozzle assembly through both said conduit means in said start-up phase; and electromagnetic detent means reponsive to said monitoring means for holding said first valve member in said unblocking position in the presence of a flame in said operating phase, thereby maintaining a flow of gas to said nozzle assembly through said first conduit means following cutoff of said second conduit means upon a restoration of said control element to said normal position at the beginning of said operating phase.

2. A system as defined in claim 1 wherein said monitoring means comprises a thermoelectric sensor juxtaposed with a further nozzle.

3. A system as defined in claim 2 wherein said further nozzle is connected to said second chamber via a separate pipe forming part of said first conduit means.

4. A system as defined in claim 1, 2 or 3 wherein said flow-regulating means comprises a cylinder with a first entrance port connected to a restricted branch and a second entrance port connected to a relatively unrestricted branch of said first conduit means, said cylinder being provided with a seat between said entrance ports and with a piston coacting with said seat for selectively throttling the gas flow through said urestricted branch via said first entrance port without affecting the flow through said restricted branch via said second entrance port to an exit port beyond said seat.

5. A system as defined in claim 4 wherein said seat is a tapering annular shoulder engageable by a resilient gasket on saiid piston.

6. A system as defined in claim 4 wherein said piston is manually displaceable in said cylinder.

7. A system as defined in claim 4 wherein said flow-regulating means further includes thermometric means operatively coupled with said piston for displacing same toward said seat in response to rising temperatures in a space heatable by said burner.

8. A system as defined in claim 7 wherein said thermometric means comprises a fluid-filled bulb communicating with a bellows adjoining said piston for displacing same against a biasing force in response to thermal expansion of the fluid in said bulb.

9. A system as defined in claim 1, 2 or 3 wherein said nozzsle assembly is provided with a gas-operated igniter connected to said third chamber.

10. A system as defined in claim 1, 2 or 3 wherein said control element comprises a push rod.

11. A system as defined in claim 1, 2 or 3 wherein said first, second and third chambers are in cascade with one another.

* * * * *